US006702514B2

(12) United States Patent
Kaneko et al.

(10) Patent No.: US 6,702,514 B2
(45) Date of Patent: Mar. 9, 2004

(54) PAVING MATERIAL FOR FOOTWAYS AND METHOD OF PRODUCING THE SAME

(75) Inventors: Masaichi Kaneko, Sakai (JP); Tetsuo Itoh, Chiba (JP); Koichi Mahira, Ichihara (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 0 days.

(21) Appl. No.: 10/177,758

(22) Filed: Jun. 24, 2002

(65) Prior Publication Data

US 2003/0012600 A1 Jan. 16, 2003

(30) Foreign Application Priority Data

Jun. 27, 2001 (JP) ..... P2001-194532

(51) Int. Cl.[7] ..... E01C 5/22
(52) U.S. Cl. ..... 404/32; 404/44; 404/82
(58) Field of Search ..... 404/32, 36, 17, 404/31, 44, 72, 82

(56) References Cited

U.S. PATENT DOCUMENTS 4,910,073 A * 3/1990 Tamura et al. ..... 428/215
5,204,159 A * 4/1993 Tan ..... 428/143
5,302,049 A * 4/1994 Schmanski ..... 404/42
5,820,294 A * 10/1998 Baranowski ..... 404/36
6,401,365 B2 * 6/2002 Kita et al. ..... 36/28

FOREIGN PATENT DOCUMENTS

| | | |
|---|---|---|
| JP | 6-4105 | 1/1994 |
| JP | 11-117219 | 4/1999 |
| JP | 2000-204508 | 7/2000 |
| JP | 2000-319808 | 11/2000 |
| JP | 2001-49606 | 2/2001 |
| JP | 2001-270772 | 10/2001 |

* cited by examiner

*Primary Examiner*—Robert E. Pezzuto
*Assistant Examiner*—Tara L. Mayo
(74) *Attorney, Agent, or Firm*—Armstrong, Kratz, Quintos, Hanson & Brooks, LLP

(57) ABSTRACT

A paving material for footways, possessing high strength and lightweight property. The paving material for footways, comprising an upper layer and a lower layer, wherein the upper layer is made of rubber chips (A1) and a synthetic resin (A2) for binding the rubber chips (A1), and the lower layer is made of a fiber-reinforced plastic (B).

11 Claims, No Drawings

PAVING MATERIAL FOR FOOTWAYS AND METHOD OF PRODUCING THE SAME

BACKGROUND OF THE INVENTION

1. Field of the Invention

The present invention relates to a paving material for footways, which is superior in strength, lightweight property and water permeability, and a method of producing the same.

2. Description of Related Art

As a conventional paving material for footways, there have been known (1) a paving material for footways comprising two layers wherein the upper layer is obtained by binding rubber chips with a urethane resin binder, and the lower layer is obtained by binding gravel with a binder (Japanese Utility Model Application, First Publication No. Hei 6-4105), (2) a paving material for footways comprising three layers wherein the upper layer is obtained by binding only rubber chips with a binder, the intermediate layer is obtained by binding a mixture of rubber chips and gravel with a binder, and the lower layer is obtained by binding rubber chips with a binder (Japanese Unexamined Patent Application, First Publication No. 2000-204508), (3) a paving material for footways obtained by binding a mixture of gravel and rubber chips with a urethane resin binder (Japanese Unexamined Patent Application, First Publication No. 2001-270772), and (4) a paving material for footways obtained by binding a mixture of rubber chips and crushed fragments of artificial marble with a binder (Japanese Unexamined Patent Application, First Publication No. Hei 11-117219). These paving materials for footways have not been satisfactory paving materials for footways because while they are superior in elasticity, they are insufficient in one of strength, lightweight property or water permeability.

BRIEF SUMMARY OF THE INVENTION

An object of the present invention is to provide a paving material for footways, which is superior in strength and lightweight property.

Another object of the present invention is to provide a paving material for footways, which is superior in strength, lightweight property, water permeability and walkability.

Still another object of the present invention is to provide a paving material for footways, which reuses waste FRP molded article and is superior in strength, lightweight property, water permeability and walkability.

The present invention provides a paving material for footways, comprising an upper layer and a lower layer, wherein the upper layer is made of rubber chips (A1) and a synthetic resin (A2) for binding the rubber chips (A1), and the lower layer is made of a fiber-reinforced plastic (B).

Also, the present invention provides a method of producing a paving material for footways, comprising a first step of charging a mixture of rubber chips (A1) for forming an upper layer and a synthetic resin (A2) for binding the rubber chips (A1) into a mold; a second step of charging a mixture of crushed fragments (B1) of a fiber-reinforced plastic, for forming a lower layer, and a thermosetting resin (B2) into the mold; and a third step of pressing the mold under heating, thereby integrally molding the mixtures.

Furthermore, the present invention provides a method of producing a paving material for footways, comprising a first step of laying a mixture of crushed fragments (B1) of a fiber-reinforced plastic, for forming a lower layer, and a thermosetting resin (B2) on a base to be paved; a second step of laying a mixture of rubber chips (A1), for forming an upper layer and a synthetic resin (A2) for binding the rubber chips (A1) thereon; and a third step of integrating and curing the mixtures.

The paving material for footways of the present invention is superior in strength, lightweight property, durability and water permeability and can also utilize waste rubber and waste FRP.

According to the present invention, it is possible to employ a waste rubber and a thermosetting resin waste, which have been exclusively subjected to landfill disposal, in the paving material for footways. Furthermore, since the paving material for footways can be cut by a woodworking saw without using a cutter for stone material and also can be easily cut to match odd-shaped floors or roadsides even when the odd-shaped road is paved with blocks, laying can be easily carried out and the effect of reducing the laying time can be achieved. After use, the paving material for footways of the present invention can be utilized as it is as a raw material and fuel for cement after incineration, and is suitable for a recycling society.

DETAILED DESCRIPTION OF THE INVENTION

The rubber chips (A1) used in the upper layer are in the form of chips obtained by cutting a rubber material made from components such as natural rubber, polyisoprene rubber, styrene rubber, butadiene rubber, chloroprene rubber, butyl rubber, nitrile rubber, ethylene-propylene rubber, ethylene-propylene-diene rubber (EPDM), chlorosulfonated polyethylene, urethane rubber, acrylic rubber or polysulfide rubber, and is preferably crushed fragments of waste rubber made of these components or crushed fragments of rubber products such as used tires or tubes.

The rubber chips (A1) are produced by crushing the rubber product using a publicly known and conventional machine and are preferably in the form of fibers or granules, and the average particle diameter is preferably within a range of from 0.5 to 20 mm, and more preferably from 1 to 10 mm. These rubber chips are used alone or in combination.

The synthetic resin (A2) used in the upper layer may be a synthetic resin capable of binding the rubber chips (A1). Examples of the synthetic resin include polyurethane resin, epoxy resin, vinyl ester resin, and unsaturated polyester resin. Preferably, the synthetic resin is a polyurethane resin. The polyurethane resin used herein is preferably in the form of liquid at normal temperature and is a terminal NCO group-containing urethane prepolymer, which is preferably prepared by reacting publicly known polyols with an organic isocyanate compound at an equivalent ratio NCO/OH of 1.5 or more, and more preferably from 1.5 to 2.0, and the polyurethane resin is a one-pack type resin made of these polyurethane polymers or a mixture thereof, or a two-pack type resin prepared by mixing the urethane polymer with the polyol. The organic isocyanate compound is a compound selected from aromatic diisocyanates and aliphatic diisocyanates such as 2,4-tolylene diisocyanate (abbreviated to TDI), 65/35-TDI, 80/20-TDI, 4,4'-diphenylmethane diisocyanate (abbreviated to MDI), dianisidine diisocyanate, tolylene diisocyanate, methaxylene diisocyanate, hexamethylene diisocyanate, phenylene diisocyanate, 1,5-naphthalene diisocyanate, polymethylenepolyphenyl polyisocyanate, hydrogenated MDI, and hydrogenated TDI alone or a mixture thereof.

The upper layer is composed of the rubber chips (A1) and the synthetic resin (A2), but it is preferred to mix in hard granules (A3) in order to prevent sliding and to control the elasticity.

Specific examples of the hard granules (A3) include the crushed fragments of thermosetting resin molded articles, the crushed fragments of fiber-reinforced plastics of thermosetting resins, and inorganic substances (e.g. aggregate such as sand, stone or mineral, or filler such a calcium carbonate). Specific examples of the thermosetting resin used in the crushed fragments of the thermosetting resin molded articles include unsaturated polyester resin, vinyl ester resin, phenol resin, melamine resin, epoxy resin, and acrylic resin. The crushed fragments of fiber-reinforced plastics are preferred. As used herein, the term "fiber-reinforced plastic" refers to a molded article (hereinafter referred to as an FRP molded article) produced by mixing a radical-curable unsaturated resin such as unsaturated polyester resin, vinyl ester resin, or crosslinkable acrylic resin (acrylic syrup) with a glass fiber reinforcing material and curing the mixture. An unsaturated polyester resin glass fiber-reinforced molded article is particularly preferred. Although the crushed fragments of the waste of the FRP molded article are preferred as the hard granules (A3), not only the recovery material thereof, but also failed waste material from the time of molding can also be included.

The mixing ratio of the rubber chips (A1) to the hard granules (A3), (A1):(A3), is preferably within a range of from 50:50 to 100:0 (by weight), and preferably from 70:30 to 95:5 (by weight). The upper layer preferably contains hard granules (A3) because the resulting paving material has the hardness and feeling of wood, which is intermediate between rubber and plastic, and also has improved properties such as abrasion resistance and sliding resistance. When the ratio of the hard granules (A3) to the rubber chips (A1) is controlled within the range described above, since the upper layer of the paving material for footways of the present invention has appropriate elasticity, a pavement using the paving material is preferably superior in walking feel. The hard granules (A3) used in the upper layer are preferably smaller than those used in the lower layer and have an average particle diameter of 0.05 to 10 mm, and also have an average particle diameter of 1 to 10 mm when they are in the form of fibers or plates. In the formation of the upper layer, the curable urethane resin used as the synthetic resin (A2) is preferably used as a binder in the upper layer in an amount within a range of from 5 to 30% by weight, and more preferably from 7 to 25% by weight, in addition to the mixture prepared by mixing the rubber chips (A1) with the hard granules (A3) made of crushed fragments of a fiber-reinforced plastic at the above mixing ratio. When the amount of the curable urethane resin is within the above range, the resulting paving material has good curability and excellent elasticity, has little foaming, and is also superior in water permeability.

The fiber-reinforced plastic (B) used in the lower layer is preferably a thermosetting resin fiber-reinforced molded article obtained by press molding a mixture of a fiber reinforcing material and the above thermosetting resin. For example, it is a molded article obtained from a molding material such as sheet molding compound (SMC) or a bulk molding compound (BMC). More preferably, it is a radical curable unsaturated resin glass fiber-reinforced molded article, and particularly preferably a molded article obtained from a glass fiber reinforcing material and a radical curable unsaturated resin such as vinyl ester resin or unsaturated polyester resin.

The crushed fragments of the thermosetting resin molded article or the crushed fragments of the fiber-reinforced plastic may be obtained by crushing using any crushing method, but inexpensive crushed fragments obtained by crushing using a conventionally used crusher is preferably used. In that case, it is not necessary to separate glass fibers or the like from composite materials. The crushed fragments may be any of single substances in the form of powder, fibers, rods, plates granules, or mixtures thereof. The average particle diameter of granules is preferably within a range of from 0.05 to 20 mm, and more preferably from 0.05 to 15 mm. The lengths of crushed fragments in the form of threads or fibers are preferably within a range of from 1 to 20 mm, and more preferably from 1 to 15 mm. The diameters of the crushed fragments in the form of plates are within a range of from 1 to 20 mm and the thicknesses are within a range of from 0.5 to 10 mm, and preferably from 1 to 15 mm, and the lengths are within a range of from 0.5 to 7 mm. The crushed fragments for the upper layer to be mixed with the rubber chips may be any of single substances in the form of powder, threads, fibers, plates, granules, or mixtures thereof. It is preferred that the crushed fragments for the lower layer be exclusively composed of granules having an average particle diameter within a range of from 1 to 15 mm.

The size distribution of the crushed fragments may be any distribution as long as the size is within a range of from 0.05 (minimum) to 20 mm (maximum). When granules having a minimum size within a range of from 0.05 to 1 mm account for 20% of the entire granules, the resulting paving material has fine appearance, while the paving material has slightly coarse appearance even if granules accounts for 20% or less of entire granules. However, the resulting paving material is satisfactory. A method of using a crusher equipped with a screen having a sieve opening diameter within a range of from 4 to 20 mm is preferably used. A method of using a screen sieve opening diameter of 2 mm or less is not preferred because of poor crushing efficiency.

Specific examples of the thermosetting resin molded article include circuit boards (epoxy resin), parts of electric and electronic equipment (phenol resin), decorative laminated sheets (melamine resin), and artificial marble (unsaturated polyester resin, vinyl ester resin) molded articles.

Specific examples of the molded article (FRP molded article) of the fiber-reinforced plastic include household items (e.g. bathtubs, bath room panels, waterproof pans, washstands, washballs, kitchen counters, and purifying chambers), industrial items (e.g. pipes and water tanks), various electric parts, ships, boats, automotive parts, helmets, mannequins, and chairs.

The fiber reinforcing material in the FRP molded article is made of inorganic fibers such as glass fibers, metal fibers and ceramic fibers and an average fiber length is preferably 10 mm or less, and more preferably within a range of from 0.1 to 5 mm. Particularly preferred are glass fibers. The form of the fibers may be any of plain weave, satin weave, nonwoven fabric, mat and glass roving.

The lower layer is made of a fiber-reinforced plastic (B) and is preferably prepared by binding crushed fragments (B1) of a thermosetting resin fiber-reinforced plastic with a thermosetting resin (B2), as a binder, which is liquid at normal temperature. The amount of the crushed fragments (B1) is preferably within a range of from 50 to 100% by volume of components excluding the thermosetting resin (B2). The amount of the thermosetting resin (B2) as the binder is preferably within a range of from 5 to 20% by weight, and more preferably from 7 to 16% by weight, in the lower layer. The amount of the crushed fragments (B1) of the reinforced plastic is within a range of from 80 to 95% by weight, and more preferably from 93 to 84% by weight.

The paving material for footways of the present invention preferably has voids in the upper layer and the lower layer. As used herein, the term "percentage of voids" refers to a percentage obtained by multiplying by 100 a value which is obtained by dividing the total volume of voids by the entire volume of a paving material for footways. The percentage of voids in the entire paving material for footways is preferably within a range of from 5 to 40%, and more preferably from 10 to 30%. The percentage of voids in the lower layer is preferably within a range of from 5 to 40%. The percentage of voids in the upper layer is preferably within a range of from 1 to 10%. When the amount of the thermosetting resin (B2) is within the above range, it is possible to obtain a satisfactory paving material for footways which appropriately achieves the percentage of voids and is superior in its lightweight property.

The percentage of voids in the paving material for footways is calculated by the following equation (1):

$$\text{Percentage of voids}=\text{"}X-Y/X\text{"}\times 100 \qquad \text{(Equation 1)}$$

X: the volume of the paving material for footways of the present invention (calculated by length×width×height)

Y: an amount of water displaced from a container filled with water after immersing the paving material for footways of the present invention X−Y: the total volume of entire voids.

The crushed fragments (B1) of the thermosetting resin reinforced plastic used herein preferably have particle sizes larger than the particle sizes of those used in the upper layer so as to achieve the above percentage of voids. When using those having a large particle size, voids increase and, therefore, the resulting paving material becomes advantageous in view of its lightweight property and water permeability. The particle size is preferably larger than the particle size of those used in the upper layer by about 0.5 to 3 mm.

The thermosetting resin (B2) is, for example, an unsaturated polyester resin, a urethane resin, a phenol resin, a melamine resin, or an epoxy resin, and is preferably an unsaturated polyester resin. The unsaturated polyester resin is usually in the form of a styrene monomer solution of the unsaturated polyester. The thermosetting resin further contains radical polymerization initiators and, if necessary, curing accelerators and is cured at normal temperature or under heating.

The ratio of the thickness of the upper layer to the thickness of the lower of the paving material for footways of the present invention, (the thickness of the upper layer):(the thickness of the lower layer), is preferably within a range of from 5:95 to 50:50. The ratio of the thickness of the upper layer to the thickness of the lower layer is appropriately decided taking account of the walking feel, the running feel, durability and economic efficiency.

The paving material for footways of the present invention is in the form of block or plate wherein the upper layer and the lower layer constitute an integrated molded article, and preferably has a length within a range of from 100 to 1000 mm, a width within a range of from 100 to 1000 mm, and a thickness within a range of from 5 to 100 mm, and preferably from 10 to 60 mm. When the thickness is 30 mm or less, the paving material is preferably applied on a base using an adhesive. When the thickness is 40 mm or more, a laying method is employed in which a sand layer is formed on a base and then the paving material is laid.

Although the lower layer is mainly composed of a fiber-reinforced plastic (B), granules of inorganic substances such as stone or mineral can also be used in combination as long as the objects of the present invention are not adversely affected when using the crushed fragments (B1) of the fiber-reinforced plastic. For the purpose of recycling, combustible organic substances such as plastics, wood chips and straw are preferably used in combination so that the paving material for footways of the present invention can be used as a raw material and fuel for cement and steel industries, as a result of recycling. When mixing, these materials are preferably mixed mechanically using a mixing apparatus such as kneader or mixer.

The paving material for footways of the present invention is exclusively used in outdoor footways and is suited for use in sidewalks, promenades, jogging courses, parking lots, external ditches around residences, sidewalks in and outside of parks, and balcony tiles.

The method of producing the paving material for footways of the present invention comprises a first step of charging a mixture of rubber chips (A1) for forming an upper layer and a synthetic resin (A2) for binding the rubber chips (A1) into a mold; a second step of charging a mixture of crushed fragments (B1) of a fiber-reinforced plastic, for forming a lower layer, and a thermosetting resin (B2) into the mold; and a third step of pressing the mold under heating, thereby integrally molding the mixtures. The mold is a block-shaped or plate-shaped mold for press molding and the surface temperature of the mold is within a range of from normal temperature to 200° C., and preferably from 100 to 200° C. The order of charging the mixture as the raw material for the upper layer and the lower layer into the mold is decided by the design of the mold. The mixture of the raw material for the upper layer may be charged first into the mold, and then the mixture of the raw material for the lower layer may be charged into the mold, and it is possible to reverse the order. For example, the mixture of rubber chips (A1), the crushed fragments (B1) of a fiber-reinforced plastic and a synthetic resin (A2), which is liquid at normal temperature, as the material for the upper layer, is charged into the mold and the crushed fragments (B1) of a fiber-reinforced plastic and the thermosetting resin (B2), which is liquid at normal temperature, as the material for the lower layer, is charged into the mold, and then the mixed materials in the mold are integrally formed into a block or plate by a hot press molding method of pressing the mold under heating.

Another method of producing the paving material for footways of the present invention comprises a first step of laying a mixture of crushed fragments (B1) of a fiber-reinforced plastic, for forming a lower layer, and a thermosetting resin (B2) on a firmly prepared base to be paved (e.g. concrete or asphalt); a second step of laying a mixture of rubber chips (A1), for forming an upper layer and a synthetic resin (A2) for binding the rubber chips (A1) thereon; and a third step of integrating and curing the mixtures. In such a manner, a paving material for footways having a seamless surface can be produced by laying the mixture, which directly forms the lower layer, and the mixture, which directly forms the upper layer, in the actual site for use at a fixed thickness, in order, and subjecting it to press paving laying using a general press roller.

The paving material for footways of the present invention can also be colored. For example, the mixtures for upper and lower layers may be colored by adding pigment powders or liquid or pasty pigments. In that case, wastes discharged from the manufacturing process of pigments or the manufacturing process of other products which use pigments may be used in place of pigments. The resulting paving material may be painted or laminated with a film.

The rubber chips (A1) and the crushed fragments (B1) of the fiber-reinforced plastic used in the present invention as well as dry granules of mixable stones, mineral substances, plastics, wood chips and straw may be treated with a surface treating agent, or the granules may contain moisture. As the surface treating agent, there can be used surfactants for improving the wettability with the binder, thereby bonding and solidifying them more strongly, for example, silane coupling agents. As long as the effects of the present invention are not impaired, other additives such as plasticizers, process oils, stabilizers and ultraviolet absorbers can be used in combination.

The paving material for footways of the present invention also has such a large feature that the molded article thereof can be easily processed and cut using a portable woodworking electric rotary saw without using a cutter for cutting stone materials or causing the generation of dust when using a general saw for cutting timber.

EXAMPLES

The present invention will be described in detail by way of examples, but the present invention is not limited thereto. In the specification, parts and percentages are by weight unless otherwise specified.

Example 1

350 parts of white rubber chips having an average particle diameter of 1 to 3 mm obtained from a waste rubber of an ethylene-propylene-diene rubber (EPDM) and 200 parts of crushed fragments obtained by crushing an FRP bath unit molded article made of a beige unsaturated polyester resin and passing it through a sieve of 4 mm mesh width were mixed with 100 parts of a one-pack type urethane prepolymer having an NCO group in the molecule ("Pandex TP-1737", manufactured by DAINIPPON INK & CHEMICALS Co., Ltd.) and 3 parts of a red ion oxide powder at room temperature for about 5 minutes until a uniform mixture was obtained, using a simple mixer for mixing mortar, thereby preparing a mixture for the upper layer of a block-shaped paving material.

Then, 1350 parts of crushed fragments obtained by crushing a kitchen counter (artificial marble-like BMC) molded article and passing it through a sieve of 12 mm mesh width was charged into a separate mixer, which is the same as that described above, and 150 parts of an unsaturated polyester resin ("Polylight MPS180", manufactured by DAINIPPON INK & CHEMICALS Co., Ltd.) and 4.5 parts of a curing accelerator ("Perbutyl Z", manufactured by NOF CORPORATION) were added in order with stirring, followed by mixing at room temperature for about 5 minutes until a uniform mixture was obtained, thereby preparing a mixture for the lower layer.

Separately, 1214 parts of the mixture for the lower layer were charged into a mold (15 cm in length×22 cm in width×4 cm in depth, volume: 1320 cc) treated with a releasant and was made smooth by slight pressing using a trowel and, furthermore, 264 parts of the mixture for the upper layer was charged into the mold and made smooth, and then the mold was closed. The mold was set in a molding press wherein the lower plate was controlled to 170° C. and the upper plate was controlled to 150° C. so that the mixture for the lower layer was located beneath the mixture for upper layer and, after maintaining under a pressure of 7 kgf/cm$^2$ for 15 minutes, the mold was opened to obtain a paving material for footways of 15 cm in length×22 cm in width×4 cm in depth, the upper layer of which had elasticity.

The upper layer of this paving material for footways had a thickness of 8 mm on average, and the lower layer had a thickness of 32 mm on average. The physical properties of the paving material for footways thus obtained are as follows and the paving material can be used as a block for a promenade. (The physical properties of block-shaped paving material for footways)

Appearance: red iron oxide color

Bending strength: 4 MPa (in accordance with JASS7M101)

Sliding resistance: Dry 70 (in accordance with ASTM E 303)

Wet 64 (in accordance with ASTM E 303)

Specific gravity: 1.10

Water permeability: $1.82\times10^{-2}$ (in accordance with JASS7M101)

Percentage of voids: 22%

Example 2

To a mixture of 1200 parts of crushed fragments obtained by crushing a washstand (artificial marble-like BMC) made of FRP and passing it through a sieve of 12 mm mesh width and 500 parts of crushed fragments obtained by crushing a beige FRP bath unit molded article and passing it through a sieve of 4 mm mesh width, which was prepared by using the mixer described above, 300 parts of an unsaturated polyester resin ("Polylight PM400", manufactured by DAINIPPON INK & CHEMICALS Co., Ltd.) containing 0.2% of 6% cobalt naphthenate added therein and 4.5 parts of a curing accelerator ("Permeck N", manufactured by NOF CORPORATION) were added in order, followed by uniform mixing for about 5 minutes using the mixture described above to obtain a mixture for the lower layer. This mixture was laid on a firm asphalt concrete at a thickness of 20 mm using a steel press roller. The resulting paving material was completely cured at room temperature after about 5 hours.

Then, a mixture prepared by mixing 1000 parts of rubber chips having an average particle diameter of 1 to 3 mm obtained by crushing waste tires with 230 parts of a urethane resin ("Pandex TP-1221", manufactured by DAINIPPON INK & CHEMICALS Co., Ltd.) in the same manner as described above was laid on the lower layer in a thickness of 20 mm using a steel press roller. The resulting upper layer was completely cured at room temperature after about 15 hours to obtain a paving material for footways.

This paving material for footways had a specific gravity of 0.98 and water permeability, while the lower layer was rigid and firm, the upper layer had elasticity and withstood walking and running by people who wearing golf shoes or spiked shoes for field-and-track events.

What is claimed is:

1. A paving material for footways, comprising an upper layer and a lower layer, wherein the upper layer is made of rubber chips (A1) and a synthetic resin (A2) for binding the rubber chips (A1), and the lower layer is made of a fiber-reinforced plastic (B), said fiber-reinforced plastic (B) in the lower layer being made of a cured article of crushed fragments (B1) of a fiber-reinforced plastic and a thermosetting resin (B2).

2. A paving material for footways according to claim 1, wherein the upper layer and the lower layer each have voids and a total volume of voids in the upper layer and the lower layer accounts for 5 to 40% of an entire volume of the paving material for footways.

3. A paving material for footways according to claim 1, wherein the fiber-reinforced plastic (B) in the lower layer is made of a cured article of 80 to 95% by weight of crushed fragments (B1) of a fiber-reinforced plastic and 5 to 20% by weight of a thermosetting resin (B2).

4. A paving material for footways according to claim 1, wherein the upper layer further comprises hard granules (A3).

5. A paving material for footways according to claim 4, wherein a mixing ratio of the rubber chips (A1) in the upper layer to the hard granules (A3), (A1):(A3), is within a range of from 70:30 to 95:5 by weight.

6. A paving material for footways according to claim 1, wherein the crushed fragments (B1) of the fiber-reinforced plastic are crushed fragments of a waste fiber-reinforced plastic.

7. A paving material for footways according to claim 1, wherein the synthetic resin (A2) is a curable urethane resin.

8. A paving material for footways according to claim 1, wherein the thermosetting resin (B2) is an unsaturated polyester resin.

9. A paving material for footways according to claim 1, wherein a ratio of a thickness of the upper layer to a thickness of the lower layer, (the thickness of the upper layer):(the thickness of the lower layer), is within a range of from 5:95 to 50:50.

10. A method of producing a paving material for footways, comprising a first step of charging a mixture of rubber chips (A1) for forming an upper layer and a synthetic resin (A2) for binding the rubber chips (A1) into a mold; a second step of charging a mixture of crushed fragments (B1) of a fiber-reinforced plastic, for forming a lower layer, and a thermosetting resin (B2) into the mold; and a third step of pressing the mold under heating, thereby integrally molding the mixtures.

11. A method of producing a paving material for footways, comprising a first step of laying a mixture of crushed fragments (B1) of a fiber-reinforced plastic, for forming a lower layer, and a thermosetting resin (B2) on a base to be paved; a second step of laying a mixture of rubber chips (A1) for forming an upper layer, and a synthetic resin (A2) for binding the rubber chips (A1) thereon; and a third step of integrating and curing the mixtures.

* * * * *